United States Patent [19]

Lee

[11] 4,225,126

[45] Sep. 30, 1980

[54] SURGICAL OPERATION TABLES

[75] Inventor: Norman J. Lee, London, England

[73] Assignee: Matburn (Holdings) Limited, London, England

[21] Appl. No.: 77,788

[22] Filed: Sep. 21, 1979

[30] Foreign Application Priority Data

Oct. 5, 1978 [GB] United Kingdom ..... 39412/78

[51] Int. Cl.[3] ..... A61G 13/00

[52] U.S. Cl. ..... 269/322; 403/328

[58] Field of Search ..... 269/322–328; 403/322, 324, 325, 328

[56] References Cited

FOREIGN PATENT DOCUMENTS

| | | | |
|---|---|---|---|
| 640539 | 5/1962 | Canada | 269/322 |
| 2817989 | 11/1978 | Fed. Rep. of Germany | 269/322 |
| 471249 | 8/1937 | United Kingdom | 403/328 |

*Primary Examiner*—Robert C. Watson

*Attorney, Agent, or Firm*—McAulay, Fields, Fisher, Goldstein & Nissen

[57] ABSTRACT

A surgical operation table has a patient supporting platform including a main section and a removable extension section. The extension section has a pair of support arms which can be inserted in sockets at the sides of the main section. A toothed wheel is located in at least one of the sockets. At least one of the support arms has teeth which mesh with the teeth of the toothed wheel when the support arm is inserted in the socket. The toothed wheel is rotatable only in a direction to permit the support arm to be inserted in the socket so that once the support arm has been inserted in the socket it cannot be withdrawn unless the toothed wheel is disengaged from the teeth of the support arm. The toothed wheel is mounted on a shaft which is axially displaceable by pressure on a plunger to disengage the wheel from the teeth of the support arm.

2 Claims, 3 Drawing Figures

SURGICAL OPERATION TABLES

BACKGROUND OF THE INVENTION

Surgical operation tables comprise a patient supporting surface, sometimes called a table top or platform and hereinafter referred to as a platform, a base which may be fixed, but which is usually movable, and a support column which supports the platform on the base in such a way that the platform can be raised or lowered with respect to the base. It is commonplace for such a table to have a platform composed of a main section and an extension section removably fitted to one end of the main section. There can be two extension sections, one removably fitted to each end of the main section and the main section, usually called a trunk section, is frequently divided into two sections called upper and lower trunk sections.

An object of the present invention is to provide a surgical operation table with an improved arrangement for securing an extension section to an end of the platform, which arrangement enables the extension to be firmly and automatically locked in position while nevertheless being easily releasable as desired.

BRIEF SUMMARY OF THE INVENTION

The invention provides a surgical operation table with a patient supporting platform and an extension section removably fitted adjacent an end of the platform wherein the said end section has a pair of support arms removably engageable in complementary sockets of the platform, at least one of the support arms having teeth engageable with a toothed wheel in the associated socket when the arm is inserted in the socket, the said toothed wheel being rotatable only in a direction to permit the support arm to be moved into the socket whereby once the arm is inserted in the socket it cannot be removed while the teeth of the arm are engaged with the wheel, means being also provided for disengaging the wheel from the teeth of the arm when it is desired to remove the extension section. The means permitting the said wheel to rotate only in one direction, may for example, be a sprag clutch.

BRIEF DESCRIPTION OF THE ACCOMPANYING DRAWINGS

DESCRIPTION OF A PREFERRED EMBODIMENT

In the illustrated embodiment of the invention, a surgical operation table comprises a platform or table top on which a patient can be supported in a supine position. The platform comprises a main or trunk section 1 carried in any suitable way by a support column 2 on a base 3. The main or trunk section 1 may if desired be sub-divided into two sections, namely upper and lower trunk sections as illustrated, or it may be a single section. The base 3 may be movable or it may be fixed. As illustrated, a removable extension section 4 is fitted to one end of the main section 1. If desired, an extension section can be fitted to each end of the main section. For convenience of description, the table will hereinafter be described with one extension section 4 arranged to be fitted to one end of the main section.

Operation tables of this kind are known and the present invention is concerned with means for fixing and locking the extension section 4, or each of them to the main section 1.

Figure 1:
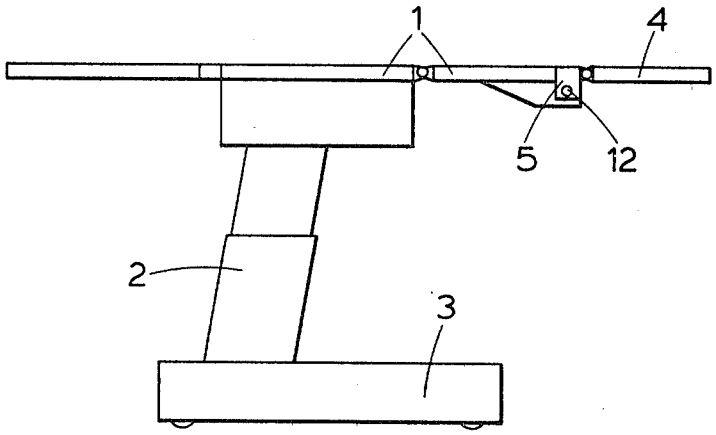
FIG. 1 is a schematic elevation of a surgical operation table.
Figure 2:
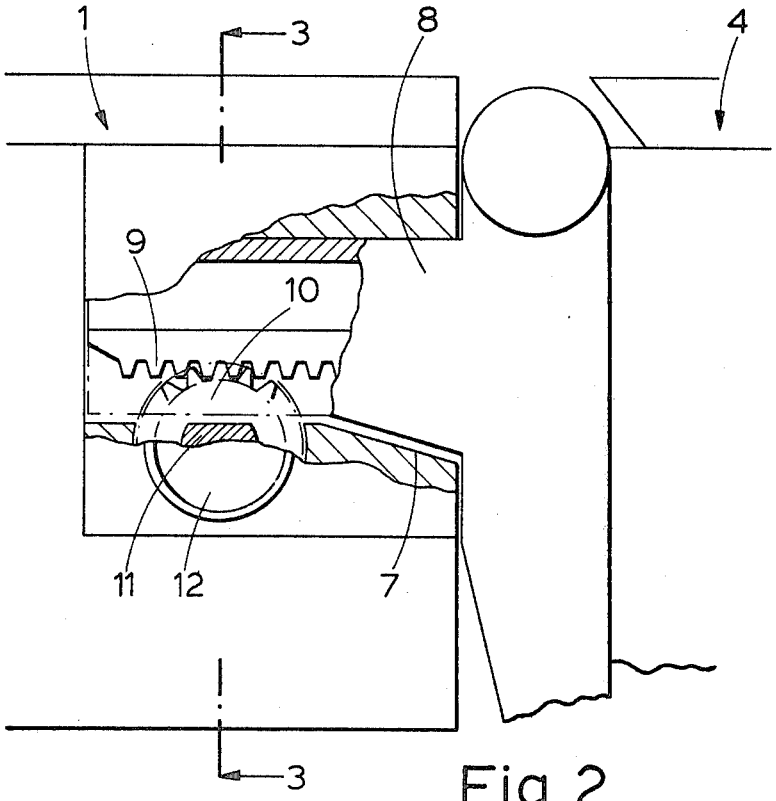
FIG. 2 is a scrap section of part of a socket and a supporting arm of an extension section forming part of the table and, FIG. 3 is a section on the line 3—3 of FIG. 2.
Figure 3:
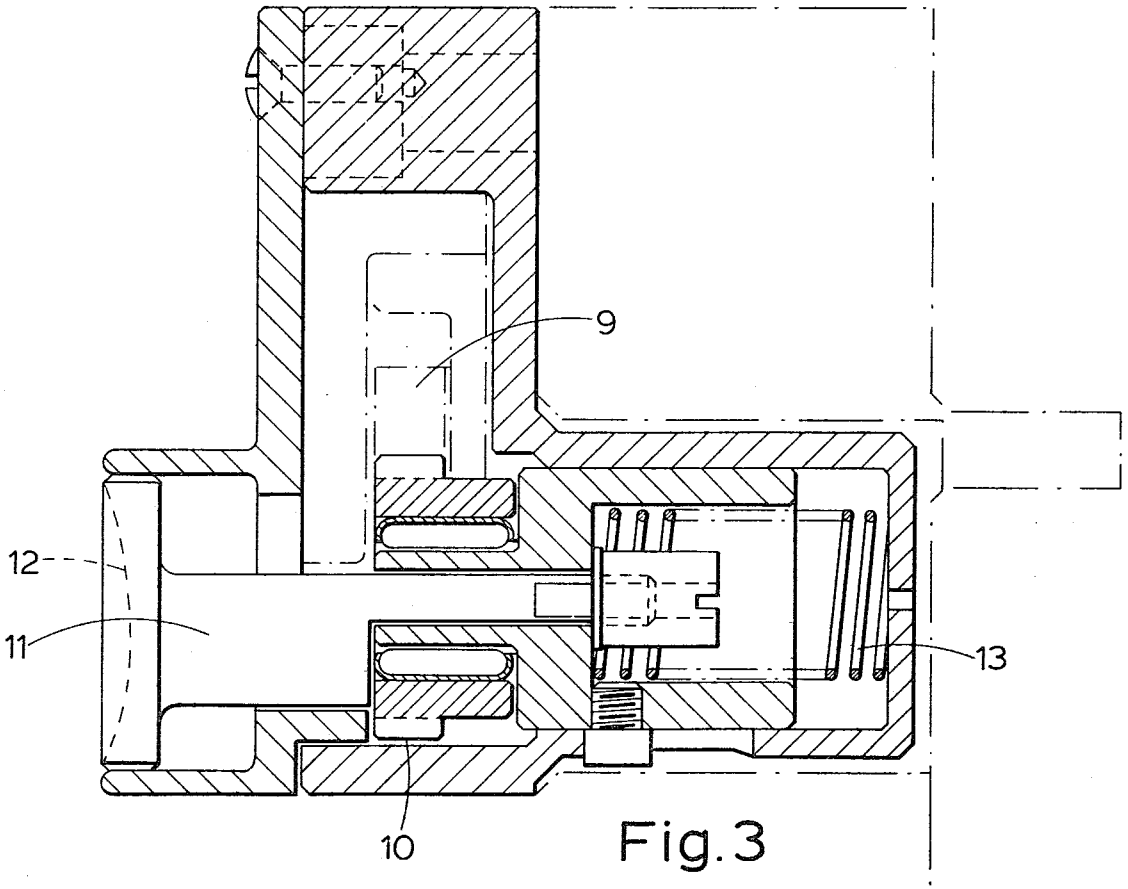

In the illustrated embodiment of the invention, a pair of extension support sockets 5 are secured to the main section 1 near one end. These sockets are disposed one at each side of the main section. Each socket is open at the end of the main section. Each socket has an outwardly flared portion 7 at its open end. The extension section 4 has a pair of support arms 8 which can be inserted in the sockets to hold the end section in the position illustrated in FIG. 1. Each support arm 8 has a rack portion with teeth 9. When a support arm 8 is inserted in a socket 5, these teeth 9 mesh with teeth of a toothed wheel 10 in the socket 5. Thus, as the arms 8 are pushed into the sockets 5, the wheels 10 rotate. The wheels are arranged to be rotatable only in one direction, i.e. a direction to permit the insertion of the arms 8 into the sockets. A sprag clutch may be provided for this purpose since the wheels 10 can rotate only in one direction, the arms 8 cannot be withdrawn from the sockets once they have been inserted in the sockets. Thus, the wheels 10 act as locking devices.

In order to withdraw the arms 8 from the sockets 5, the wheels 10 must be disengaged from the teeth 9 of the support arms 8. For this purpose, each wheel 10 is supported on a shaft 11 which is axially displaceable by pressure on a plunger 12 at the side of the table. Each wheel is displaceable against the action of a return spring 13. Thus, when it is desired to remove the extension section from the main section the plungers 12 at each side of the table are depressed to move the wheels 10 sideways out of engagement with the teeth 9. When the wheel has been disengaged from the teeth 9, the arms 8 can slide out of the sockets to enable the end section to be withdrawn. When the arms have been fully withdrawn, the wheels 10 will spring back to their normal locking position under the action of the return spring 13.

It is possible to provide such locking arrangements in each of the sockets on the two sides of the table. Alternatively, only one of the sockets need have the locking device.

If desired such a locking arrangement may be provided at each end of the table.

What is claimed is:

1. A surgical operation table comprising a main patient supporting section; an extension section removably fitted to an end of said main section; support arms on said extension, at least one of said arms having teeth; sockets arranged on said main section to receive said support arms; a toothed wheel located in at least one of said sockets and arranged so that said teeth of said support arm mesh with the teeth of said toothed wheel when said support arm is inserted in said socket, said toothed wheel being rotatable only in a direction to permit said support arm to be inserted in said socket whereby said support arm cannot be removed from said socket while said teeth are meshing; and means for disengaging said toothed wheel from said teeth of said support arm when it is desired to remove said extension section.

2. A surgical operation table as claimed in claim 1 comprising a shaft on which said toothed wheel is supported, said shaft being axially displaceable; a return spring arranged to resist displacement of said shaft in a direction to disengage said teeth of said toothed wheel from said teeth of said support arm; and a plunger for displacing said shaft in a direction to disengage said teeth.

* * * * *